US006970135B2

(12) United States Patent
Sato et al.

(10) Patent No.: US 6,970,135 B2
(45) Date of Patent: Nov. 29, 2005

(54) ANTENNA APPARATUS

(75) Inventors: Akinori Sato, Kyoto (JP); Shunichi Murakawa, Kyoto (JP); Kazuo Watada, Kyoto (JP); Hiroshi Yoshizaki, Kyoto (JP)

(73) Assignee: Kyocera Corporation, Kyoto (JP)

( * ) Notice: Subject to any disclaimer, the term of this patent is extended or adjusted under 35 U.S.C. 154(b) by 171 days.

(21) Appl. No.: 10/246,389

(22) Filed: Sep. 18, 2002

(65) Prior Publication Data

US 2003/0063036 A1 Apr. 3, 2003

(30) Foreign Application Priority Data

Sep. 20, 2001 (JP) ..... P2001-287711

(51) Int. Cl.[7] ..... H01Q 1/24
(52) U.S. Cl. ..... 343/702; 343/846
(58) Field of Search ..... 343/702, 700 MS, 343/846, 848, 850

(56) References Cited

U.S. PATENT DOCUMENTS

| | | | | |
|---|---|---|---|---|
| 4,063,246 A | * | 12/1977 | Greiser | 343/700 MS |
| 6,111,544 A | | 8/2000 | Dakeya et al. | 343/700 MS |
| 6,433,746 B2 | * | 8/2002 | Kushihi et al. | 343/700 MS |
| 6,728,559 B2 | | 4/2004 | Masaki | 343/700 MS |

FOREIGN PATENT DOCUMENTS

| | | | |
|---|---|---|---|
| CN | 1299193 | 6/2001 | H04B/5/02 |
| JP | 5-226919 | 9/1993 | H01Q/1/32 |
| JP | 11-27025 | 1/1999 | H01Q/1/24 |
| JP | 2000-101335 | 4/2000 | H01Q/13/08 |

* cited by examiner

*Primary Examiner*—Hoang V. Nguyen
(74) *Attorney, Agent, or Firm*—Hogan & Hartson, LLP

(57) ABSTRACT

The invention provides an antenna apparatus including a driven element formed of a rectangular conductor, and a grounding plate which is arranged in proximity to at least one of side edges of the driven element, with a predetermined interval secured therebetween. This construction requires less mounting space, achieves wide bandwidth and low conductor loss.

16 Claims, 5 Drawing Sheets

ANTENNA APPARATUS

BACKGROUND OF THE INVENTION

1. Field of the Invention

The present invention relates to a compact antenna apparatus for use in mobile communication equipment or the like.

2. Description of the Related Art

As small-sized antenna apparatuses for use in mobile communication equipment or the like, a variety of constructions have hitherto been proposed and used. As one well-known example of such small-sized antenna apparatuses, an inverted F antenna will be described below with reference to a plan view shown in FIG. 9.

In FIG. 9, reference numeral 11 represents a radiating element (driven element) composed of a radiating conductor portion 11*a*, a shorting conductor portion 11*b*, and a feeding portion 11*c*; 12 represents a grounding plate; and 13 represents a feeding point for the feeding portion 11*c* of the radiating element 11. The inverted F antenna having such a configuration has succeeded in reducing the size by bending a radiating element of a quarter-wavelength monopole antenna. Another feature of the inverted F antenna is that impedance matching can be achieved between the radiating element 11*a* and a feeding line (not shown) to be connected to the feeding point 13, such as a coaxial line.

A helical antenna can be taken up as another example with which compactness can be achieved. FIG. 10 is a plan view showing one example of a helical antenna. In the figure, reference numeral 14 represents a radiating element (driven element) composed of a quarter-wavelength conductor wire wound in a helical fashion; 15 represents a grounding plate; and 16 represents a feeding point for the radiating element 14. The helical antenna having such a configuration is known as a compact antenna which incurs less disturbance in directivity characteristics and excels in VSWR (Voltage Standing Wave Ratio) characteristics.

Recently, in keeping with rapid prevalence and advancement of mobile communication equipment, miniaturization has come to be increasingly demanded of the mobile communication equipment, and compact size and narrow mounting area are accordingly being demanded of an antenna for use in such equipment.

However, the structure of the inverted F antenna shown in FIG. 9 is contrary to the trend toward further miniaturization. This is because the inverted F antenna requires a considerable length equal to one quarter of wavelength, for example, needs to have a length so long as 9 cm at a frequency of 800 MHz, and is thus too large to be mounted in a small-sized mobile communication equipment.

Moreover, in general, miniaturization of an antenna gives rise to a problem of a gain being lower, as well as a problem of a bandwidth being narrower. In the helical antenna shown in FIG. 10, its electrical volume is reduced by confinement of magnetic energy. Therefore, miniaturization of such a helical antenna leads to a sharp decrease in bandwidth, thus making it extremely difficult to achieve a wide bandwidth even if a matching circuit is employed.

Another problem with the helical antenna is that there occurs relatively large conductor loss due to electric current flowing above the radiating element 14 made of a helical conductor line. When used in increasingly smaller and higher-frequency mobile communication equipment, this problem may lead to a decrease in the antenna gain.

SUMMARY OF THE INVENTION

The invention has been devised in view of the above-described problems with the conventional art, and accordingly its object is to provide a compact antenna apparatus which occupies less space for mounting, achieves a wide bandwidth, and incurs lower conductor loss.

The invention provides an antenna apparatus comprising:

a driven element formed of a rectangular conductor; and a grounding plate which is arranged in proximity to at least one of side edges of the driven element, with a predetermined interval secured therebetween.

According to the invention, the antenna apparatus includes a driven element formed of a rectangular conductor, and a grounding plate which is arranged in proximity to at least one of side edges of the driven element, with a predetermined interval secured therebetween. This construction has the following advantages. Firstly, even if the grounding plate is arranged in proximity to the driven element, a decrease in the gain can be suppressed, and thus it is possible to realize an antenna apparatus that requires less space for mounting. Secondly, by using the grounding plate as a radiating element, radiation resistance can be increased, whereby making it possible to achieve a wide bandwidth. Thirdly, since the driven element is made larger in width, it is possible to reduce the loss attributed to a resistance component observed in the driven element. Lastly, by properly selecting the shape of the driven element and securing an appropriate interval between the driven element and the grounding plate, it is possible to provide an antenna apparatus in which the conductor loss can be lowered successfully.

In the invention, it is preferable that, in the above-described construction, the grounding plate is formed of a substantially rectangular conductor and has a length and a width which are in a range of 1/5 to 1/1 times signal wavelength.

According to the invention, so long as the grounding plate is formed of a substantially rectangular conductor and has a length and a width which are in a range of 1/5 to 1/1 times signal wavelength, the current flowing through the grounding plate serves for radiation effectively. Consequently, in the antenna, the bandwidth is made wider and the radiation pattern is so configured that the main beam becomes significant. Moreover, in this case, the current flowing through the grounding plate is brought into resonance easily. In particular, if the grounding plate has a length and a width which are equal to 1/2 times signal wavelength, the antenna apparatus embodying the invention acts as an edge-feeding dipole antenna and thus exhibits wideband characteristics.

In the invention, it is preferable that, in the above-described construction, the driven element has a length in a range of 1/20 to 1/10 times signal wavelength, and has a width in a range of 1/5 to 1/1 times the length.

According to the invention, so long as the driven element has a length in a range of 1/20 to 1/10 times signal wavelength and has a width in a range of 1/5 to 1/1 times the length, it is possible to suppress the conductor loss while securing a minimum necessary electrical length. Consequently, it is possible to provide an antenna apparatus that succeeds in miniaturization while increasing the radiation efficiency.

In the invention, it is preferable that, in the above-described construction, an interval between the driven element and the grounding plate is kept in a range of 1/200 to 1/30 times signal wavelength.

According to the invention, so long as an interval between the driven element and the grounding plate is kept in a range of 1/200 to 1/30 times signal wavelength, it is possible to reduce the conductor loss occurring in the grounding plate and the driven element while reducing the mounting space. Consequently, it is possible to provide an antenna apparatus that succeeds in miniaturization while increasing the radiation efficiency.

In the invention, it is preferable that, in the above-described construction, the driven element and the grounding plate are arranged on the same plane of a top surface or interior of a substrate made of a dielectric or magnetic body.

According to the invention, so long as the driven element and the grounding plate are arranged on the same plane of a top surface or interior of a substrate made of a dielectric or magnetic body, there is no need to design the antenna apparatus so as to extend in a direction perpendicular to the substrate. Consequently, it is possible to provide an antenna apparatus of low profile.

In the invention, it is preferable that, in the above-described construction, the driven element and the grounding plate are arranged on different planes of a top surface or interior of a substrate made of a dielectric or magnetic body.

According to the invention, so long as the driven element and the grounding plate are arranged on different planes of a top surface or interior of a substrate made of a dielectric or magnetic body, a gap is created between the driven element and the grounding plate, as observed in the substrate thickness direction. Consequently, a so-called cut-out region provided in the grounding plate can be reduced in area, whereby making it possible to realize a compact antenna apparatus and to further reduce the space required for mounting the driven element.

In the invention, it is preferable that the driven element is connected to a feeding point via a matching circuit.

In the invention, it is preferable that the grounding plate is formed of a substantially rectangular conductor and has a length and a width which are less than 1/1 times signal wavelength.

In the invention, it is preferable that the grounding plate has a part cut out which part corresponds to the driven element.

According to the invention, there is provided a compact antenna apparatus which requires less mounting space, achieves a wide bandwidth, and incurs low conductor loss.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
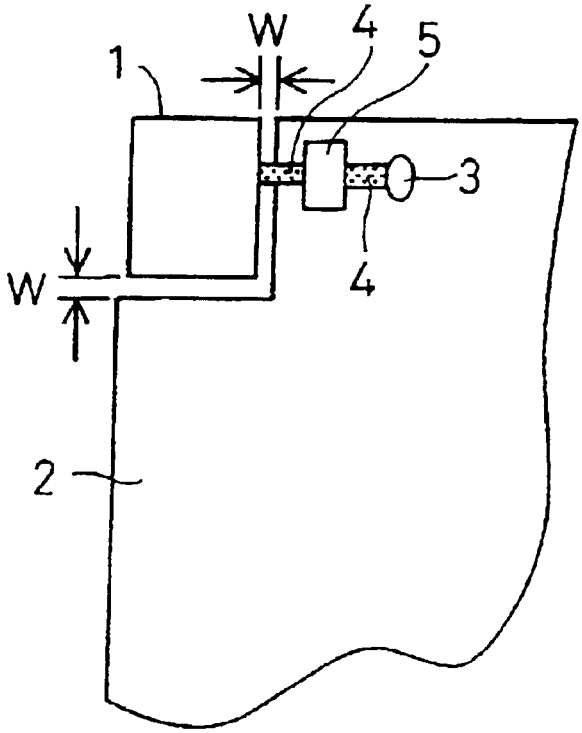
FIG. 1 is a plan view showing an antenna apparatus according to one embodiment of the invention.

Now referring to the drawings, preferred embodiments of the invention are described below.

FIG. 1 is a plan view showing an antenna apparatus according to one embodiment of the invention. In FIG. 1, reference numeral 1 represents a driven element formed of a rectangular conductor, and 2 represents a grounding plate which is arranged in proximity to at least one of side edges of the driven element, here, two side edges thereof, with predetermined intervals secured therebetween. Moreover, reference numeral 3 represents a feeding point for feeding to the driven element 1; 4 represents a feeding conductor for constituting a feeding path by electrically connecting the driven element 1 to the feeding point 3; and 5 represents a matching circuit disposed partway along the length of the feeding conductor 4 so as to be located between the feeding point 3 and the driven element 1. The matching circuit 5, which is provided on an as needed basis, is composed of an inductance component, a capacitance component, etc., required for inductance matching and impedance matching that are conducted to compensate for the electrical length of the driven element 1. Reference symbol W represents a predetermined interval secured between the driven element 1 and the grounding plate 2.

According to the antenna apparatus embodying the invention, the driven element 1, formed of a rectangular conductor, is of a small-sized element made of a conductor material such as copper foil or silver. The driven element 1 has an extremely short electrical length kept in a range of 1/20 to 1/10 times signal wavelength (1/20 to 1/10 wavelength long). Arranged in proximity to at least one of side edges of the driven element 1 with a predetermined interval is the grounding plate 2 in which, in accompaniment with feeding to the driven element 1, electric current corresponding to the signal is induced. Said driven element 1 and grounding plate 2 constitute the antenna. With such an arrangement, electric current can be induced in the grounding plate 2, resulting in an increase in radiation resistance. Consequently, a compact, wideband antenna can be realized.

Further, in the antenna apparatus embodying the invention, because of its simple structure, conductor loss, which occurs when signal power flows through the driven element 1 and the grounding plate 2, appears minimal. Thus, a decrease in antenna gain resulting from the conductor loss can be kept at a minimum.

Figure 2:
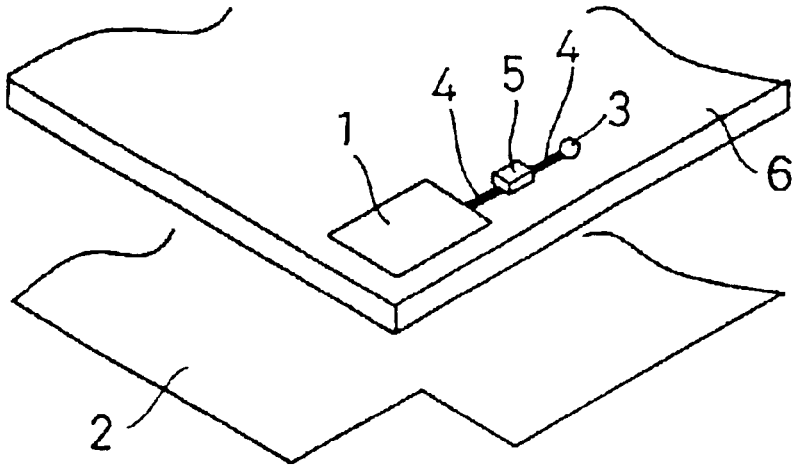
FIG. 2 is an exploded perspective view showing the antenna apparatus according to the embodiment of the invention.

The antenna apparatus of one embodiment of the invention is shown as an exploded perspective view in FIG. 2. In FIG. 2, the components that play the same or corresponding roles as in FIG. 1 will be identified with the same reference symbols, and thus reference numeral 1 represents a driven element; 2 represents a grounding plate; 3 represents a feeding point; 4 represents a feeding conductor; and 5 represents a matching circuit. Moreover, reference numeral 6 represents a substrate made of a dielectric or magnetic body. For example, the substrate 6 is made of a dielectric material such as glass epoxy, PTFE (polytetrafluoroethylene), or alumina ceramics, or a magnetic material such as Ni—Zn ferrite.

In this embodiment, on the top surface of the substrate 6 are arranged the driven element 1 formed of a rectangular conductor, the feeding point 3, the feeding conductor 4, and the matching circuit 5. On the under surface of the substrate 6 is arranged the grounding plate 2, which has its corner portion cut out so as to be arranged in proximity to two side edges of the driven element 1, with predetermined intervals secured therebetween. That is, the driven element 1 and the grounding plate 2 are arranged on different planes of the surface of the substrate 6.

More specifically, in the construction according to this embodiment, as the substrate 6, a glass epoxy substrate (having a rectangular shape of 40 mm ×30 mm in size, 0.6 mm in thickness, with a relative dielectric constant of 4.8) is used for example. As the driven element 1, a rectangular conductor plate of 9 mm long ×3 mm wide is used. The driven element 1 is arranged at the corner portion of the top surface of the substrate 6. As the grounding plate 2 arranged on the under surface of the substrate 6, a conductor plate is used that has a rectangular cut-out portion of 11 mm long ×4 mm wide, so as to face two side edges of the driven element 1 at the corner portion of the substrate 6. In this way, it is possible to realize an antenna apparatus which is operable at a frequency of approximately 2.4 GHz.

Next, with reference to equivalent circuit diagrams shown in FIGS. 3 and 4, a description will be given below as to the role of the matching circuit 5 employed in the antenna apparatus embodying the invention.

Figure 3:
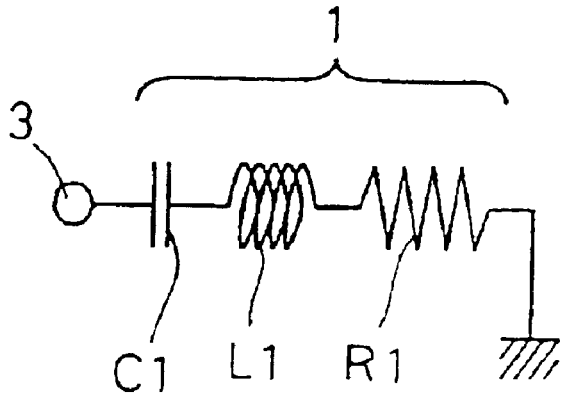
FIG. 3 is an equivalent circuit diagram showing an equivalent circuit of the antenna apparatus embodying the invention, as observed when a matching circuit is absent.

FIG. 3 is an equivalent circuit diagram showing an equivalent circuit associated with the driven element 1, as observed when no matching circuit 5 is provided. In the antenna apparatus embodying the invention, since the driven element 1 is extremely small in length, for example, 1/20 to 1/10 wavelength long, if the matching circuit 5 is absent, the driven element 1 exhibits capacitive characteristics. By feeding to the driven element 1 at the feeding point 3, electric current is induced in the proximately-arranged grounding plate 2, resulting in occurrence of radiation resistance. In this case, as shown in FIG. 3, the equivalent circuit of the driven element 1 is constituted by connecting capacitance C1, inductance L1, and radiation resistance R1 in series with each other.

Hereupon, in the above-described specific example, C1 is given as 1.2 pF, L1 is given as 1.2 nH, and R1 is given as 3.5 Ω under evaluation at a frequency of approximately 2.4 GHz.

Figure 4:
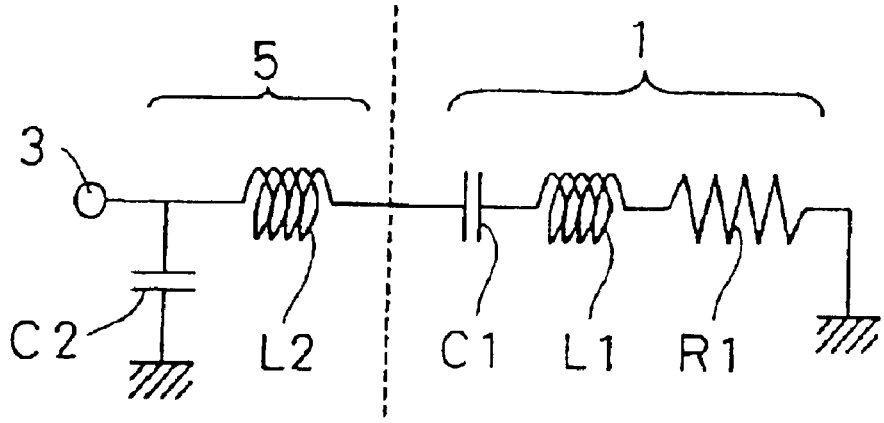
FIG. 4 is an equivalent circuit diagram showing the equivalent circuit of the antenna apparatus embodying the invention, as observed when a matching circuit is present.

FIG. 4 is an equivalent circuit diagram showing an example in which the matching circuit 5 is additionally provided. The matching circuit 5 serves for achieving a match between the driven element 1 and the feeding line 4, in the case of using a 50 Ω feeding line as the feeding line 4. As shown in FIG. 4, the matching circuit 5 is composed of inductance L2 and capacitance C2. The inductance L2 is connected in series to the feeding line 4. The capacitance C2 is connected between the feeding line 4 and the grounding. In this example, a match can be achieved by setting the inductance L2 at 2nH and setting the capacitance C2 at 4.5 pF. The impedance bandwidth obtained as the result of the match is given as 100 MHz when the Voltage Standing Wave Ratio (VSWR) is 2 (relative bandwidth: 4%), and is given as 200 MHz when the Voltage Standing Wave Ratio is 3 (relative bandwidth: 8%). Consequently, wideband characteristics can be attained.

In the antenna apparatus embodying the invention, when the grounding plate 2 is reduced in size below a certain level, R1 is decreased sharply, resulting in the impedance bandwidth being narrower. In connection with this tendency, listed hereunder is the data on the correspondence between the size of the grounding plate 2 and the impedance bandwidth, as examined in the above-described specific example. Note that the grounding plate 2 has a rectangular shape as a whole, strictly speaking, a substantially rectangular shape because of cutting out a part which corresponds to the driven element 1.

| Grounding Plate Size | Impedance Bandwidth |
|---|---|
| 20 mm × 15 mm | 40 MHz |
| 40 mm × 30 mm | 100 MHz |
| 50 mm × 50 mm | 100 MHz |

As will be understood from the data, the larger the size (length and width) of the grounding plate 2 made of a substantially rectangular conductor, the broader the impedance bandwidth. If the grounding plate 2 is given a size equal to or greater than 1/5 wavelength (1/5 times signal wavelength) (greater than approximately 25 mm at a frequency of ca. 2.4 GHz), the impedance bandwidth is saturated. It should be noted here that, if the grounding plate 2 has a size equal to or greater than 1 wavelength (1/1 times signal wavelength) (greater than approximately 125 mm at a frequency of ca. 2.4 GHz), distortion tends to occur in the signal radiation pattern.

In the antenna apparatus embodying the invention, the driven element 1, the area of the cut-out conductor portion of the grounding plate 2, and the interval W between the driven element 1 and the grounding plate 2 are all key elements to attain satisfactory antenna characteristics. The antenna apparatus embodying the invention is constructed basically in the same manner as in the previously-described specific example except that, at the corner portion of the top surface of the glass epoxy substrate 6 is arranged the driven element 1 made of a rectangular conductor plate of 11 mm long ×5 mm wide, and that, at the corner portion of the under surface of the substrate 6 is proximately arranged the grounding plate 2 which has a rectangular cut-out conductor portion of 13 mm long ×6 mm wide so as to face two side edges of the driven element 1 (both of the two side intervals W secured between the driven element 1 and the grounding plate 2 are set at 1 mm). In this construction, the impedance bandwidth is given as 260 MHz when the Voltage Standing Wave Ratio is 2 (relative bandwidth: 10%). Consequently, remarkably wide bandwidth characteristics can be attained.

As would be clear from the results of the study on the equivalent circuit, by increasing the capacitance C1 and the radiation resistance R1 of the driven element 1, a wideband antenna apparatus can be realized.

In the antenna apparatus embodying the invention, the interval W between the driven element 1 and the grounding plate 2 is of particular importance from the viewpoint of attaining satisfactory antenna characteristics. If the interval W is made small, in the driven element 1, the capacitance C1 is increased, whereas the radiation resistance R1 is decreased. Hence, extensive study has been conducted including examination of component values, etc. of chip components for use as circuit components in the matching circuit 5. In conclusion, to attain satisfactory antenna characteristics, the interval W between the driven element 1 and the grounding plate 2 should desirably be kept in a range of 1/200 to 1/30 times signal wavelength (1/200 to 1/30 wavelength long, e.g. approximately 0.5 to 2 mm with respect to a signal of ca. 2.4 GHz). If the interval W is less than 1/200 times signal wavelength, the radiation efficiency is decreased. By contrast, if the interval W is greater than 1/30 times signal wavelength, the periphery of the driven element 1 becomes unduly large in structure, which leads to the difficulty in achieving miniaturization of the antenna apparatus, and to the impossibility of providing appreciable mounting advantage.

Moreover, as the result of the study on the relationship between the length and the width of the driven element 1, formed of a rectangular conductor, of the antenna apparatus embodying the invention, it has been found desirable to keep the length of the driven element 1 in a range of 1/20 to 1/10 times signal wavelength (1/20 to 1/10 wavelength long). If the length is less than 1/20 times signal wavelength, the frequency tends to vary greatly due to variation in the inductance of the matching circuit 5 inserted for the purpose of compensating for the electrical length, and also the loss of the inductance becomes problematic. By contrast, if the length is greater than 1/10 times signal wavelength, the periphery of the driven element 1 becomes unduly large in structure, which leads to the difficulty in achieving miniaturization of the antenna apparatus, and to the impossibility of providing appreciable mounting advantage. On the other hand, it has been found that, the smaller the width of the driven element 1, the smaller the radiation resistance R1 and the capacitance C1 thereof tend to be, and the impedance bandwidth is thus considerably narrow, resulting in the antenna being made impractical. From this finding, it has been found desirable to keep the width in a range of 1/5 to 1/1 times the length in order to attain the most satisfactory radiation characteristics. If the width is less than 1/5 times the length, the conductor loss becomes unduly great. By contrast, if the width is greater than 1/1 times the length, it becomes difficult to perform feeding to the driven element 1 effectively.

Figure 5:
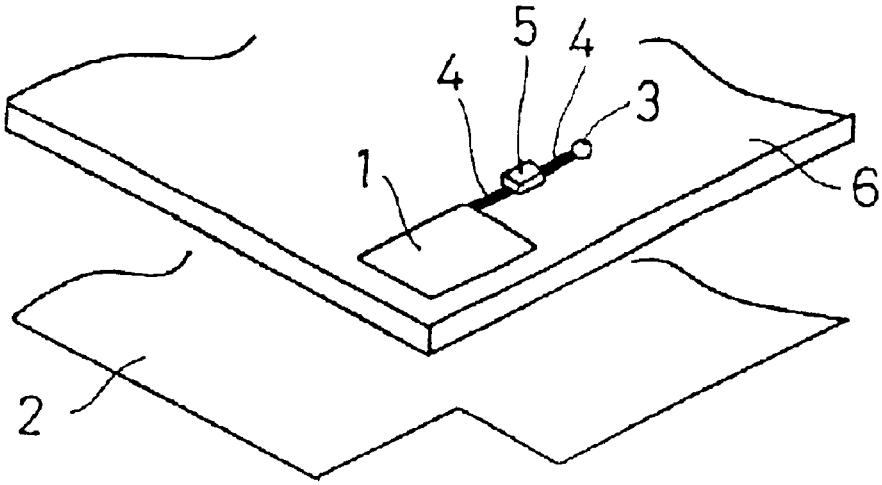
FIG. 5 is an exploded perspective view showing the antenna apparatus according to another embodiment of the invention.

In the antenna apparatus embodying the invention, the feeding position, at which the driven element 1 is fed from the feeding point 3 through the matching circuit 5, is such as is described in the embodiment shown in FIG. 2. Alternatively, as seen in the embodiment shown in the exploded perspective view of FIG. 5 alike to FIG. 2, the feeding position may be located in the vicinity of the electromagnetic neutral point of the driven element 1. In this case, in contrast to the embodiment shown in FIG. 2, the matching circuit 5 cannot be employed without changing the circuit constant.

Figure 6:
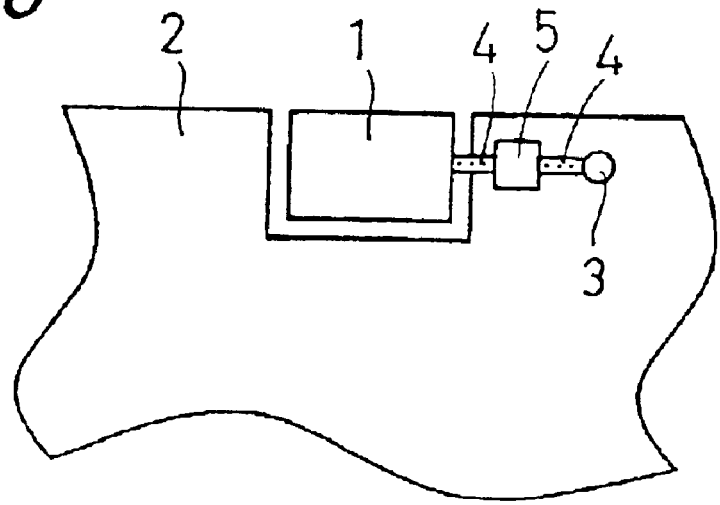
FIG. 6 is a plan view showing the antenna apparatus according to another embodiment of the invention.

Next, the antenna apparatus according to another embodiment of the invention is illustrated as a plane figure in FIG. 6, alike to FIG. 1. In FIG. 6, the components that play the same or corresponding roles as in FIG. 1 will be identified with the same reference symbols, and thus reference numeral 1 represents a driven element; 2 represents a grounding plate; 3 represents a feeding point; 4 represents a feeding conductor; and 5 represents a matching circuit. In this embodiment, on a top surface of a glass epoxy substrate (not shown) having a thickness of 0.6 mm and a relative dielectric constant of 4.8, there is arranged the driven element 1 formed of a rectangular conductor of 9 mm long ×3 mm wide. Also, on the top surface of the substrate is arranged the grounding plate 2 in proximity to the driven element 1. The grounding plate 2 has, at the midpoint of its one side edge, a rectangular cut-out conductor portion of 11 mm long ×4 mm wide so as to surround three side edges of the driven element 1. In this construction, as compared with the embodiments shown in FIGS. 1 to 3, it is difficult to induce electric current in the grounding plate 2, and thus the radiation resistance R1 of the driven element 1 is decreased. This results in the impedance bandwidth being narrow. In this example, the impedance bandwidth is given as 80 MHz when the Voltage Standing Wave Ratio is 2.

Figure 7:
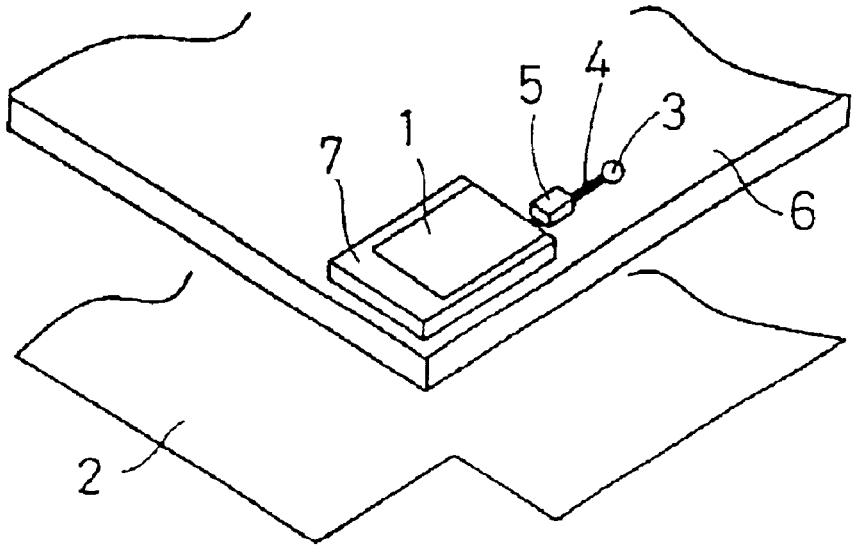
FIG. 7 is an exploded perspective view showing the antenna apparatus according to still another embodiment of the invention.

In the antenna apparatus embodying the invention, in contrast to the embodiment shown in FIGS. 1 and 2, as shown in the exploded perspective view of FIG. 7 alike to FIG. 2, by forming the driven element 1 composed of a rectangular conductor on the top surface or in the interior of the base substrate 7 made of a dielectric or magnetic body, it is possible to make the driven element 1 selectable and readily replaceable according to the desired frequency. Thereby, the mountability of the antenna apparatus can be improved.

Figure 8:
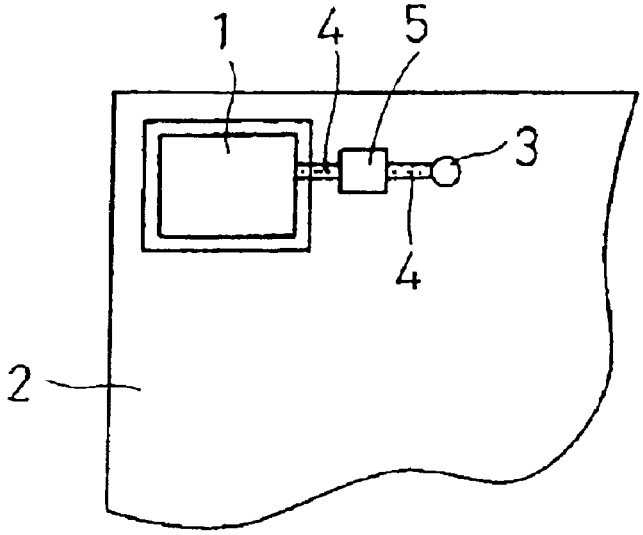
FIG. 8 is a plan view showing the antenna apparatus according to further another embodiment of the invention.
Figure 9:
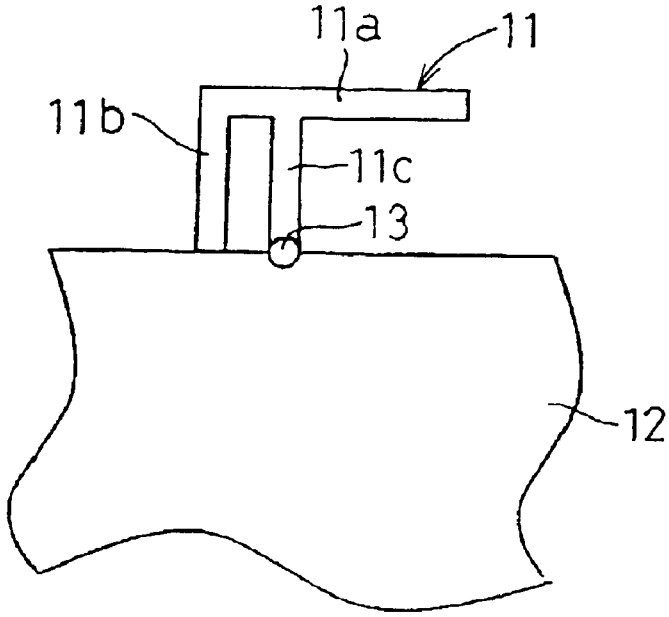
FIG. 9 PRIOR ART
FIG. 9 is a plan view showing an example of a conventional inverted F antenna.
Figure 10:
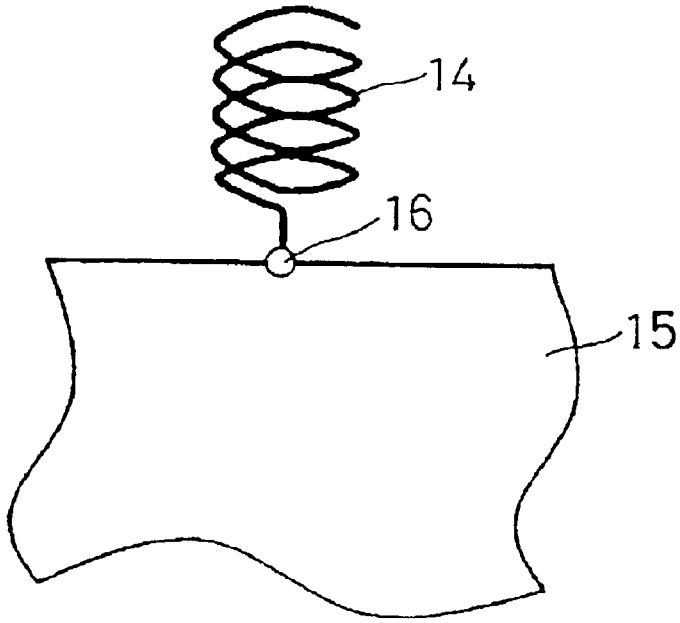
FIG. 10 PRIOR ART
FIG. 10 is a plan view showing an example of a conventional helical antenna.

The antenna apparatus according to still another embodiment of the invention is illustrated as a plane figure in FIG. 8 alike to FIG. 6. As seen from FIG. 8, the grounding plate 2 may be so configured that it is arranged in proximity to four side edges of the driven element 1, with predetermined intervals secured therebetween, so as to surround the perimeter of the driven element 1. In the antenna apparatus adopting such a configuration, the bandwidth is narrow, but high mounting flexibility can be attained.

It is to be understood that the application of the invention is not limited to the specific embodiments described heretofore, and that many modifications and variations of the invention are possible within the spirit and scope of the invention. For example, the driven element 1 may have its corners rounded off.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An antenna apparatus comprising:

a driven element formed of a rectangular conductor; and a grounding plate which is arranged in proximity to at least one of side edges of the driven element, with a predetermined interval secured therebetween;

wherein an interval between the driven element and the grounding plate is in a range of 1/200 to 1/30 times signal wavelength.

2. The antenna apparatus of claim 1, wherein the grounding plate is formed of a substantially rectangular conductor and has a length and a width which are in a range of 1/5 to 1/1 times signal wavelength.

3. The antenna apparatus of claim 1, wherein the driven element has a length in a range of 1/20 to 1/10 times signal wavelength, and has a width in a range of 1/5 to 1/1 times the length.

4. The antenna apparatus of claim 1, wherein the driven element and the grounding plate are arranged on the same plane of a top surface or interior of a substrate made of a dielectric or magnetic body.

5. The antenna apparatus of claim 4, wherein the driven element and the grounding plate arranged on the same plane of a top surface or interior of a substrate made of glass epoxy.

6. The antenna apparatus of claim 1, wherein the driven element is connected to a feeding point via a matching circuit.

7. The antenna apparatus of claim 1, wherein the grounding plate is formed of a substantially rectangular conductor and has a length and a width which are less than 1/1 times signal wavelength.

8. The antenna apparatus of claim 1, wherein the grounding plate has a part cut out which part corresponds to the driven element.

9. An antenna apparatus comprising:

a driven element formed of a rectangular conductor; and a grounding plate which is arranged in proximity to at least one of side edges of the driven element, with a predetermined interval secured therebetween, wherein the driven element and the grounding plate are arranged on different planes of top surface or interior of a substrate made of a dielectric or magnetic body.

10. The antenna apparatus according to claim 9, wherein the driven element and the grounding plate are arranged on different planes of a top surface or interior of a substrate made of a material selected from the group consisting of glass epoxy, polytetrafluoroethylene, alumina ceramics and Ni—Zn ferrite.

11. The antenna apparatus according to claim 9, wherein the driven element and the grounding plate are arranged on different planes of a top surface or interior of a substrate made of glass epoxy.

12. The antenna apparatus according to claim 9, wherein the driven element and the grounding plate are arranged on different planes of a top surface or interior of a substrate made of polytetrafluoroethylene.

13. The antenna apparatus according to claim 9, wherein the driven element and the grounding plate are arranged on different planes of a top surface or interior of a substrate made of alumina ceramics.

14. The antenna apparatus according to claim 9, wherein the driven element and the pounding plate are arranged on different planes of a top surface or interior of a substrate made of Ni—Zn ferrite.

15. The antenna apparatus according to claim 9, wherein the grounding plate is arranged in proximity to two side edges of the driven element, with predetermined intervals secured therebetween.

16. The antenna apparatus according to claim 9, wherein the grounding plate is arranged in proximity to three side edges of the driven element, with predetermined intervals secured therebetween.

* * * * *